United States Patent [19]

Monot

[11] 4,198,786

[45] Apr. 22, 1980

[54] LOCKING DEVICE FOR A SLIDING DOOR

[75] Inventor: Bernard Monot, Aubervilliers, France

[73] Assignee: Faiveley S.A., Saint Ouen, France

[21] Appl. No.: 899,852

[22] Filed: Apr. 25, 1978

[30] Foreign Application Priority Data

Feb. 16, 1978 [FR] France ..... 78 04421

[51] Int. Cl.[2] ..... E05F 11/34

[52] U.S. Cl. ..... 49/362; 49/139; 49/449; 74/89.15; 74/424.8 R; 192/141

[58] Field of Search ..... 49/362, 139, 449; 74/424.8 R, 89.15; 192/141

[56] References Cited

U.S. PATENT DOCUMENTS

| | | | |
|---|---|---|---|
| 1,900,009 | 3/1933 | Christenson | 49/362 |
| 3,745,705 | 7/1973 | Reddy | 49/362 X |
| 4,091,570 | 5/1978 | Favrel | 49/362 X |

*Primary Examiner*—Philip C. Kannan

*Attorney, Agent, or Firm*—Young & Thompson

[57] ABSTRACT

A sliding door of the type employed in public transport vehicles and driven by an electric motor comprises at least one door-leaf coupled with a nut mounted on an endless screw which is driven in rotation in order to open and/or close the door. The nut is displaced in translational motion within a guide which prevents rotational motion. The locking device comprises means for interrupting the translational displacement of the guided nut at the end of travel and for permitting angular rotation of the nut with the endless screw, means for limiting the angular displacement of the nut and finally means for limiting the translational motion of the nut if it is displaced along the endless screw and no longer engaged in the guide.

21 Claims, 28 Drawing Figures

FIG. 1
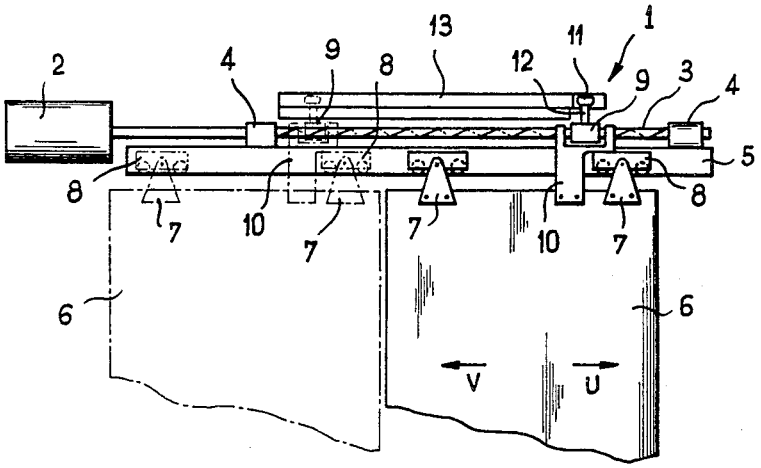
FIG. 2
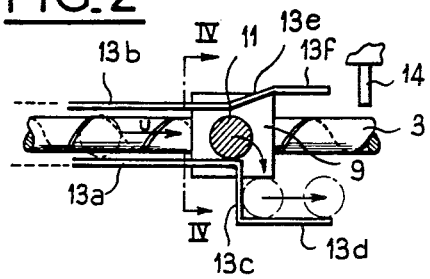
FIG. 4
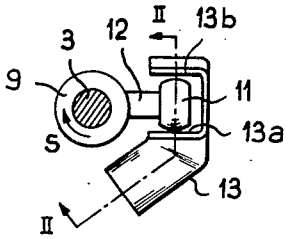
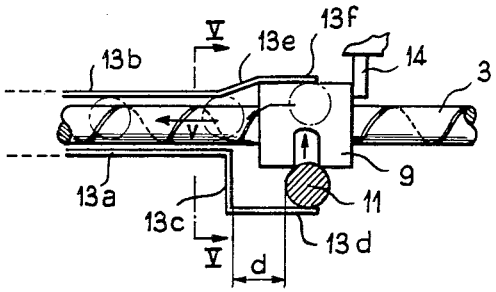
FIG. 3
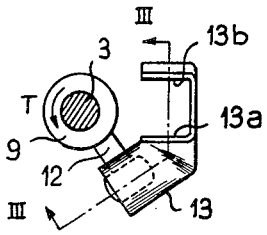
FIG. 5

FIG. 20
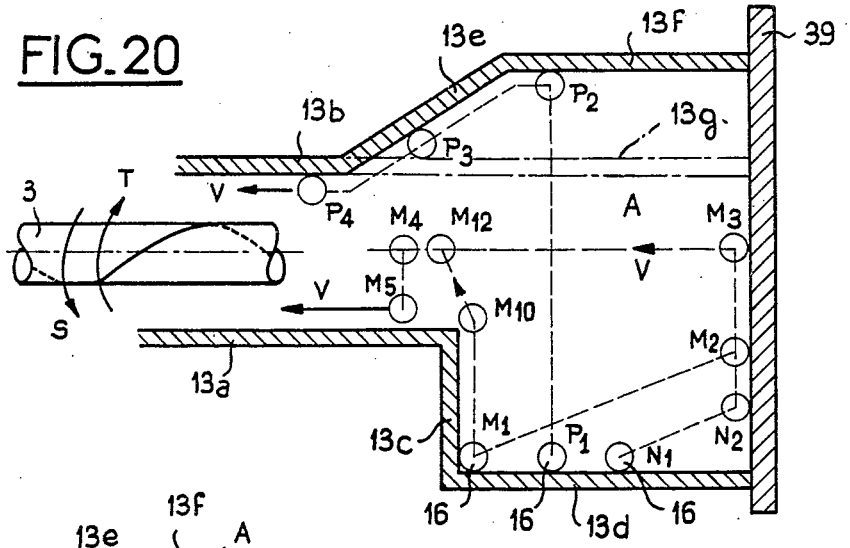
FIG. 21
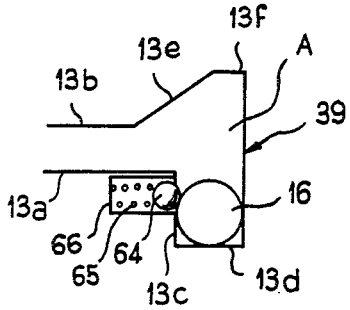
FIG. 22
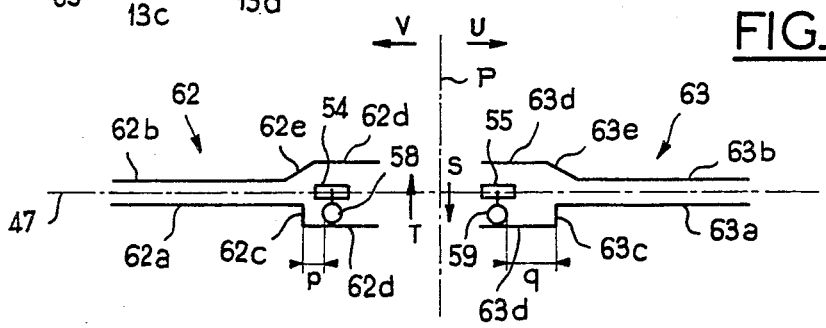
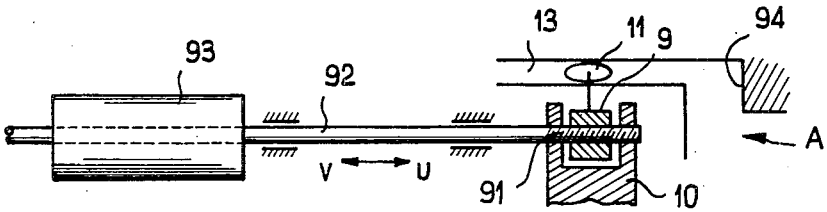
FIG. 23

LOCKING DEVICE FOR A SLIDING DOOR

This invention relates to a door-locking control device, the opening and/or closing of the door being carried out by means of a screw and nut system driven by a motor.

This device is particularly suitable for locking a sliding door or a pair of associated sliding doors such as doors of the automatic opening and/or closure type for public transport vehicles and especially railway vehicles.

It is known that doors of this type usually have locking means which are actuated by the driver and utilize the electrical, hydraulic or compressed-air supplies provided on board the vehicles.

Thus it is a known practice to lock the doors by means of a push-rod which is actuated by an electromagnetic, hydraulic or pneumatic control system and effects the displacement of a locking bolt when it is supplied by this system. When the push-rod is no longer supplied, the locking bolt returns to the inactive position under the action of a restoring spring.

In other versions, remote control of the locking bolt is ensured by transmission of a variation in hydraulic or compressed-air pressure.

Remote control of the locking operation has already been carried out by means of direct mechanical linkages.

All these known designs thus make it necessary to employ locking control devices as well as separate devices for controlling the opening and closing of doors, thereby entailing a duplication of control means.

In consequence, these designs are often cumbersome, complex, costly and sometimes unreliable.

In order to overcome this disadvantage, it has been attempted to combine the means for operating the doors with the means for controlling the locking operation.

By way of example, one known system for controlling a sliding door comprises a crank driven in rotation about an axis at right angles to the plane of the door by means of a motor. The end of said crank is guided in translational motion by means of a guide arranged along the vertical edge of the door so that rotation of the crank results in translational displacement of the door.

The crank can be constituted by two elements which slide with respect to each other and are maintained by means of an elastic restoring member in the position of maximum extension.

When the crank is horizontal, the door is locked in the closed position with a slight opening play corresponding to the possibility of compression of the elastic member. In point of fact, doors equipped in this manner are usually suspended and control of their lower portions proves unsatisfactory from a mechanical standpoint since the crank has a tendency to lift the door.

Moreover, the reduction-gear motor which drives the crank is of substantial overall size and reduces the space available for passengers since it has to be housed in the bottom portion of the vehicle.

The aim of the present invention is to overcome these disadvantages by making it possible to control the locking of one or two doors by means of a mechanism which is both compact, efficient and inexpensive to produce.

In accordance with the invention, the device for locking a door and especially a sliding door driven by a motor in which said door comprises at least one leaf coupled to a nut mounted on an endless screw driven in rotation in order to effect opening and/or closing of the door, said nut being displaced in translational motion within a guide which prevents rotational motion. The locking device essentially comprises means for interrupting the translational displacement of the guided nut at the end of travel and for permitting angular rotation of said nut with said screw, means for limiting the extent of angular displacement of said nut and finally means for limiting the translational motion of the nut if it is displaced along the screw and no longer engaged in the guide.

Thus, when guiding of the nut in translational motion in one direction is interrupted, said nut rotates about the screw in a predetermined angular displacement, is then locked translationally either in the same direction if it continues to be driven by the screw or in the opposite direction if the action on the door-leaf tends to move said nut away from its end-of-travel position.

By virtue of this combination of means, locking of the nut takes place automatically at the end of travel under the action of the system for controlling its displacement without entailing the need for a specific locking device.

Moreover, any action produced on the door-leaf which tends to move the nut away from its end-of-travel position also tends to lock said leaf.

In a first embodiment of the invention, said nut carries a projecting member which serves to locate its angular position and is provided with means for facilitating the guiding of said nut.

Moreover, the means for interrupting translational guiding of the nut consist of a limitation of the guide before the position of end of travel of said nut on the endless screw.

After said limitation of the guide, provision is advantageously made for a recessed portion which permits rotational motion of the nut, said recessed portion being provided with a stop for preventing further rotation of the nut when this latter has reached a predetermined angular position which corresponds to locking.

Preferably, the means for limiting the translational displacement of the nut when this latter is freed from the guide comprise two stops for arresting said nut, said stops being intended to limit the length of the recessed portion and to extend transversely with respect to the axis of the endless screw.

The recessed portion can thus be provided at the end of the guide in the vicinity of the end-of-travel position of the nut and receives the projecting member carried by the nut when the movement of said member is no longer controlled by the guide. The nut is thus locked within the recessed portion by means of its projecting member and stops which limit said recessed portion.

The arrangement described above has small space requirements since the projecting member is of small size. Moreover, the control device is of very simple and inexpensive design.

In accordance with one alternative form of this first embodiment of the invention, the locking device comprises remote-controlled means for returning the nut from its locking position to the predetermined angular position with respect to the guide, which corresponds to unlocking.

Thus, in the event of an electrical failure of the control system, the unlocking means which are provided make it possible to release the nut and open the door simply by producing action on the door-leaf, the endless screw being driven in rotation by the nut since the direction of rotation of said screw is reversible.

The locking device in accordance with the invention can be disposed at the end of travel on the side corresponding to either closing or opening of the sliding door or alternatively to both opening and closing of said door.

In an advantageous embodiment of the invention, the locking device applies to a door having two associated leaves operated in opposition by means of a common endless screw having two threaded portions of opposite hand, each threaded portion aforesaid being fitted with a nut coupled with one of the door-leaves in translational motion. An essential and distinctive feature of the locking device lies in the fact that, in the locking position, each nut is capable of angular displacement when driven by the enldess screw and thus escapes from the translational-motion guide which is associated with said endless screw.

The invention also applies to a door which has two associated leaves, each door-leaf being coupled with one nut in translational motion by means of a fork which embraces said nut. The two nuts are mounted on a common endless screw having two threaded portions of opposite hand and are guided in translational motion over their entire range of travel by means of a guide.

In a preferred embodiment of the invention, the locking device for a door of the type aforesaid is characterized in that it is applied to a second endless screw which is driven in rotation in both directions and carries a driving nut mounted within a fork and that connecting means provide a mechanical linkage between said fork and the forks carried by the door-leaves in order to couple them in translational motion over at least part of their range of travel. Thus a single locking device can be employed for two associated door-leaves.

Moreover, the fork associated with the door-leaf can be subjected to a relative movement of translation with respect to the driving fork, this movement being limited in the direction of opening and performed by means of a slide arranged between the two forks and an elastic restoring member which tends to maintain said slide in the position of maximum extension.

The driving nut can thus be locked on the second endless screw despite the presence of any obstacle which prevents complete closure of the two door-leaves.

This form of construction is therefore particularly suitable for the equipment of public transport vehicles.

Further distinctive features and advantages of the invention will become apparent from the following detailed description, reference being made to the accompanying drawings which are given by way of example and not in any limiting sense, and wherein:

FIG. 1 is a diagrammatic presentation of the control system of a sliding door in two end positions;

FIGS. 2 and 3 are diagrammatic part-sectional views taken along lines II—II of FIG. 4 and III—III of FIG. 5 respectively, the locking device being shown in the unlocked and then locked end-of-travel positions;

FIGS. 4 and 5 are part-sectional views taken along lines IV—IV and V—V and FIGS. 2 and 3 respectively;

FIG. 20 is a functional diagram corresponding to different modes of locking and unlocking;

FIG. 21 is a diagrammatic presentation of a particular feature of the locking device;

FIG. 22 is an explanatory diagram of the locking device for direct control of a two-leaf door;

FIG. 23 is a simplified perspective diagram of a manual unlocking device;

Figure 6:
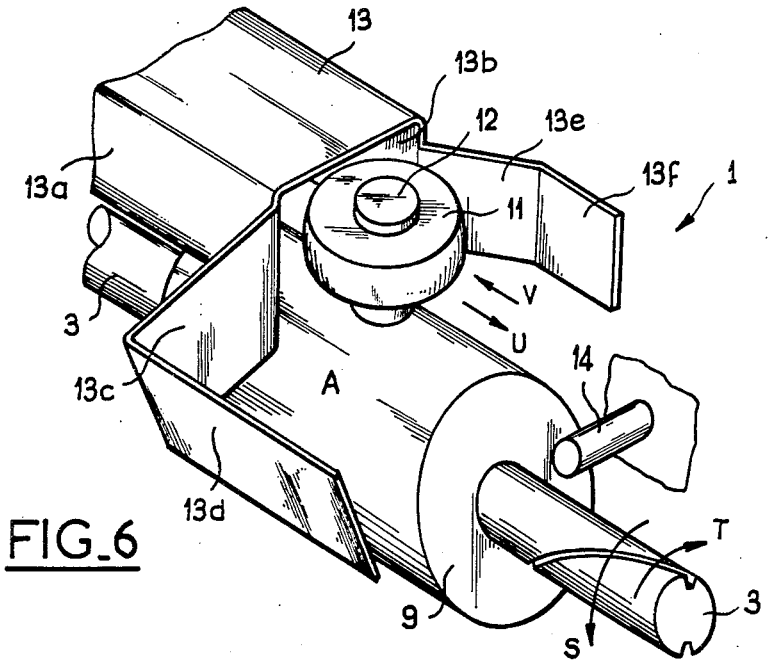
FIGS. 6 and 7 are partial diagrammatic views in perspective showing the locking device respectively in the unlocked and locked end-of-travel positions.

In the first embodiment of the invention which is described with reference to FIG. 1, the system for controlling a sliding door having a single leaf is equipped with the locking device 1 to which the invention is more especially directed.

Said control system comprises an electric motor 2 for driving an endless screw 3 in rotation, said screw being rotatably mounted in two stationary bearings 4 fixed on a rail 5 from which the sliding door-leaf 6 is suspended. The means for suspending the door-leaf 6 from the rail 5 comprise two suspension plates 7 fixed on the top edge of the door-leaf 6 and pivotally attached respectively to two carriages 8 which are capable of moving along the rail 5.

The nut 9 mounted on the endless screw 3 is coupled with the fork 10 in translational motion, said fork being in turn rigidly fixed to the door-leaf 6.

The guide 13 which is parallel to the endless screw 3 constitutes a means for guiding a roller 11 in translational motion, said roller being rotatably mounted on a shaft 12 which is rigidly fixed to the nut 9. Said shaft 12 defines the angular position of the nut 9 as will be explained hereinafter.

Figure 7:
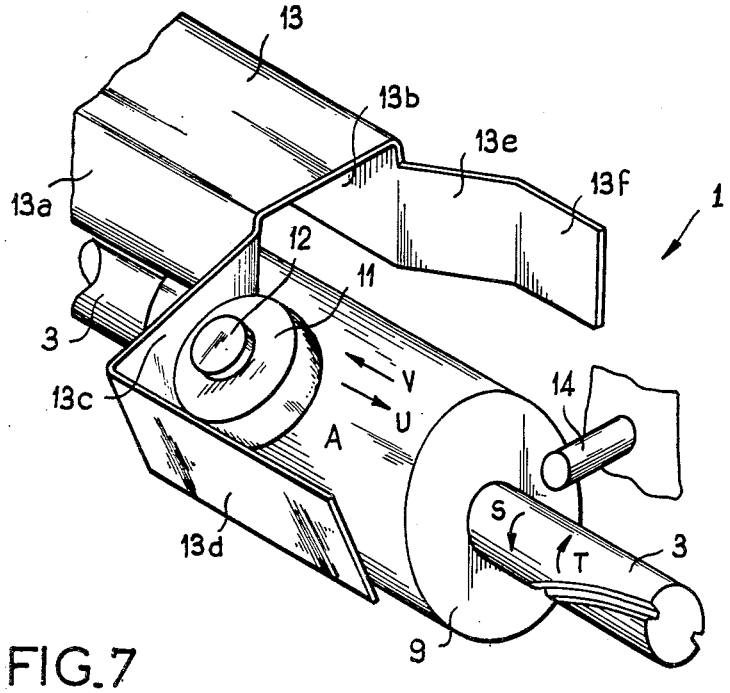

One of the end portions of the guide 13 comprises the locking device 1 which is illustrated in greater detail in FIGS. 6 and 7.

The guide 13 has two opposite and parallel bearing walls 13*a* and 13*b* spaced at a distance from each other which is slightly greater than the diameter of the roller 11.

The bearing walls 13*a* and 13*b* are interrupted at one end of the guide 13 so as to constitute a recessed portion A which is intended to receive the roller 11 at the end of travel.

Said recessed portion A comprises a wall 13*c* which is joined to the wall 13*a* and makes an angle of approximately 90° with this latter, a wall 13*d* which is joined to the wall 13*c* and is substantially at right angles thereto, an angle of approximately 45° being made between said wall 13*d* and said wall 13*a*.

In the particular example under consideration, the recessed portion A is also limited by an oblique wall 13*e* which makes an angle of approximately 30° with the wall 13*b* and is extended by a wall 13*f* which is substantially parallel to the wall 13*b*.

A stationary stop 14 is placed in the proximity of the endless screw 3 in order to constitute a means for limiting the displacement of the nut 9 in translational motion. Said stop is placed in such a manner as to ensure that a clearance d (FIG. 3) is provided between the roller 11 and the wall 13*c* when the nut is applied against said stop 14 and the roller 11 is applied against the wall 13*d*, said clearance being exaggerated in FIG. 3 for the sake of enhanced clarity.

The operation of the device as thus constituted is as follows:

When the nut 9 is moving towards the end-of-travel position and the endless screw 3 is rotating in the direction S as can be seen in FIGS. 2 to 7, the roller 11 which is applied against the face 13*a* of the guide 13 accordingly travels in the direction of the arrow U. When guiding of the roller 11 in translational motion is discontinued as a result of interruption of the bearing face 13*a*, the nut 9 which is driven by the endless screw 3 rotates and in turn drives the roller 11 in rotation along the wall 13*c* until it comes into contact with the wall 13*d* which thus constitutes a means for limiting the range of angular displacement of the nut 9. If the endless screw 3 continues to rotate, the nut 9 continues to travel in the direction of the arrow U whilst the roller 11 is guided in translational motion by the wall 13*d* while rolling in contact with this latter until the nut 9 encounters the stop 14 which limits its translational motion. The endless screw 3 is no longer permitted to rotate in the direction of the arrow S.

The door-leaf 6 which is rigidly fixed to the fork 10 (said fork being in turn coupled to the nut 9 in translational motion) has reached the end-of-travel position of the door-closing movement and is thus locked.

The supply of current to the electric motor 2 which drives the endless screw 3 is cut-off by the control means of said motor.

In order to unlock the door-leaf 6 automatically, the electric motor 2 is controlled so as to drive the endless screw 3 in rotation in the direction T. The nut 9 which is driven by the screw 3 first rotates in the direction T, whereupon the roller 11 moves from the bearing position on the wall 13*d* to the bearing position on the wall 13*f*, which constitutes a means for limiting its range of angular displacement. From this moment onwards, said roller 11 is guided in translational motion as it rolls in contact with the wall 13*f*, then with the wall 13*e* and finally with the wall 13*b* of the guide 13, thereby preventing rotational displacement of the nut 9 and causing translational displacement of this latter along the endless screw 3 in the direction V.

Thus the door-leaf 6 is unlocked automatically and slides in the direction V.

Locking and unlocking of the door-leaf in the end-of-travel position are thus performed automatically by means of a very simple kinematic system in which the means for controlling the displacement of the nut 9 along the endless screw 3 cooperate so as to produce this effect in conjunction with the means which guide the roller 11 and limit the translational and rotational displacements of this latter without any need to have recourse to specific means for controlling the locking or unlocking operation.

Moreover, when the door-leaf 6 is in the locked position and the endless screw 3 is stationary, any action produced on said door-leaf tends to move it away from its end-of-travel position in the direction V and increases the thrust of the roller 11 on the wall 13*d*, thus increasing the locking force.

In the embodiment shown in FIGS. 8 to 17, a remote-controlled unlocking device 15 is associated with the locking device 1.

Figure 9:
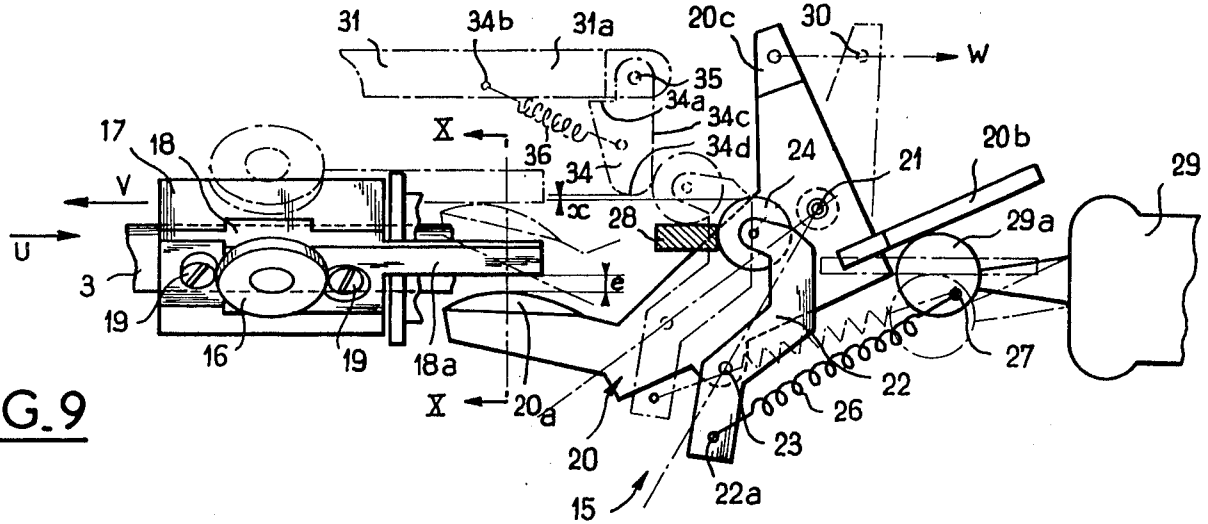
FIG. 9 is a top view taken along line IX of FIG. 10.

The nut 17 being mounted on the endless screw 3, a roller 16 is associated with said nut 17 by means of a support 18 which is rigidly fixed to said nut by means of two screws 19 (as shown in FIG. 9). Said support 18 for the roller 16 is provided with a finger 18*a* which is parallel to the endless screw 3 and directed towards the end-of-travel position.

An unlocking lever 20 which is rotatably mounted on a stationary pin 21 is so arranged that one end 20*a* of said lever is located at a distance e from the finger 18*a* in the non-unlocking position.

A pawl 22 is pivotally mounted on a pin 23 which is rigidly fixed to the unlocking lever 20. The pawl 22 carries a roller 24 at one end.

A tension spring 26 attached between the other end 22*a* of said pawl 22 and a fixed point 27 maintains the lever 20 in the unlocking position whilst the roller 24 is applied against a fixed stop 28. The unlocking lever 20 also carries an index 20*b* which is capable of bearing on the movable tip 29*a* of a position detector 29.

The end portion 20*c* of the unlocking lever 20 is connected to a remote-control member (shown diagrammatically at 30) of the unlocking device 15, such as a link-rod system.

Figure 8:
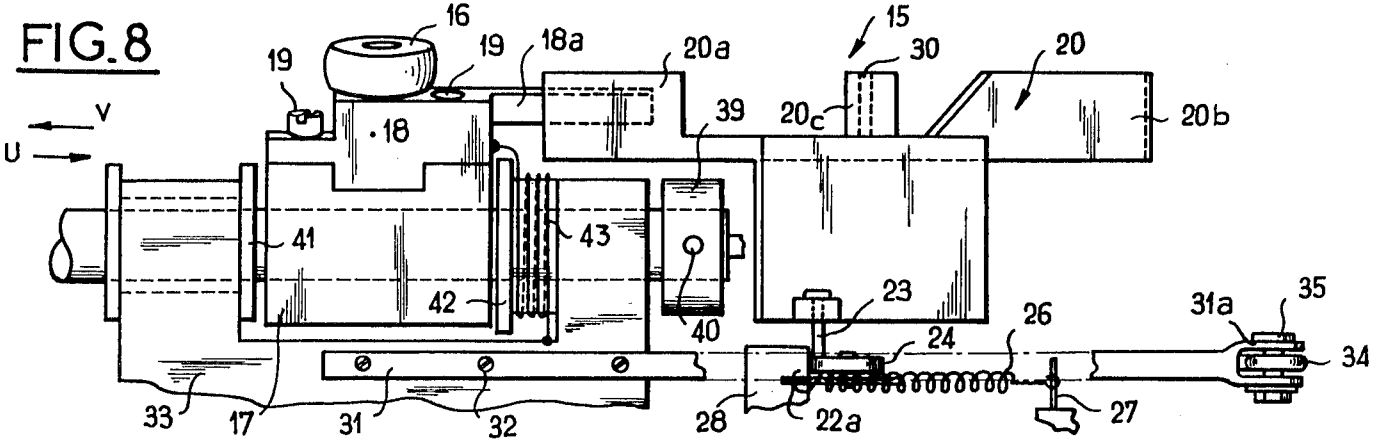
FIG. 8 is the right-hand view taken along line VIII of FIG. 10 and showing an industrial embodiment of the invention.

The fork 33 which is coupled with the nut 17 is translational motion carries a rod 31 which is fixed by means of screws 32 and extends parallel to the endless screw 3. The free end of the rod 31 which is directed towards the locking position carries a yoke 31*a* in which a lug 34 is pivoted about a pin 35. The lug 34 is provided in the direction V with a heel-shaped projection 34*a* which, in the rest position, is maintained applied against the rod 31 by means of a restoring spring 36. The lug 34 is located in the plane of the roller 24 carried by the pawl 22 and is located on the other side of the roller 24 in the locking position (FIG. 8). When the pawl 22 is in the position shown in full lines in FIG. 9 (namely the inactive position), the path of travel of the bottom portion 34*d* of the lug 34 passes at a distance x from the top portion of the roller 24.

Figures 10, 11, 24:
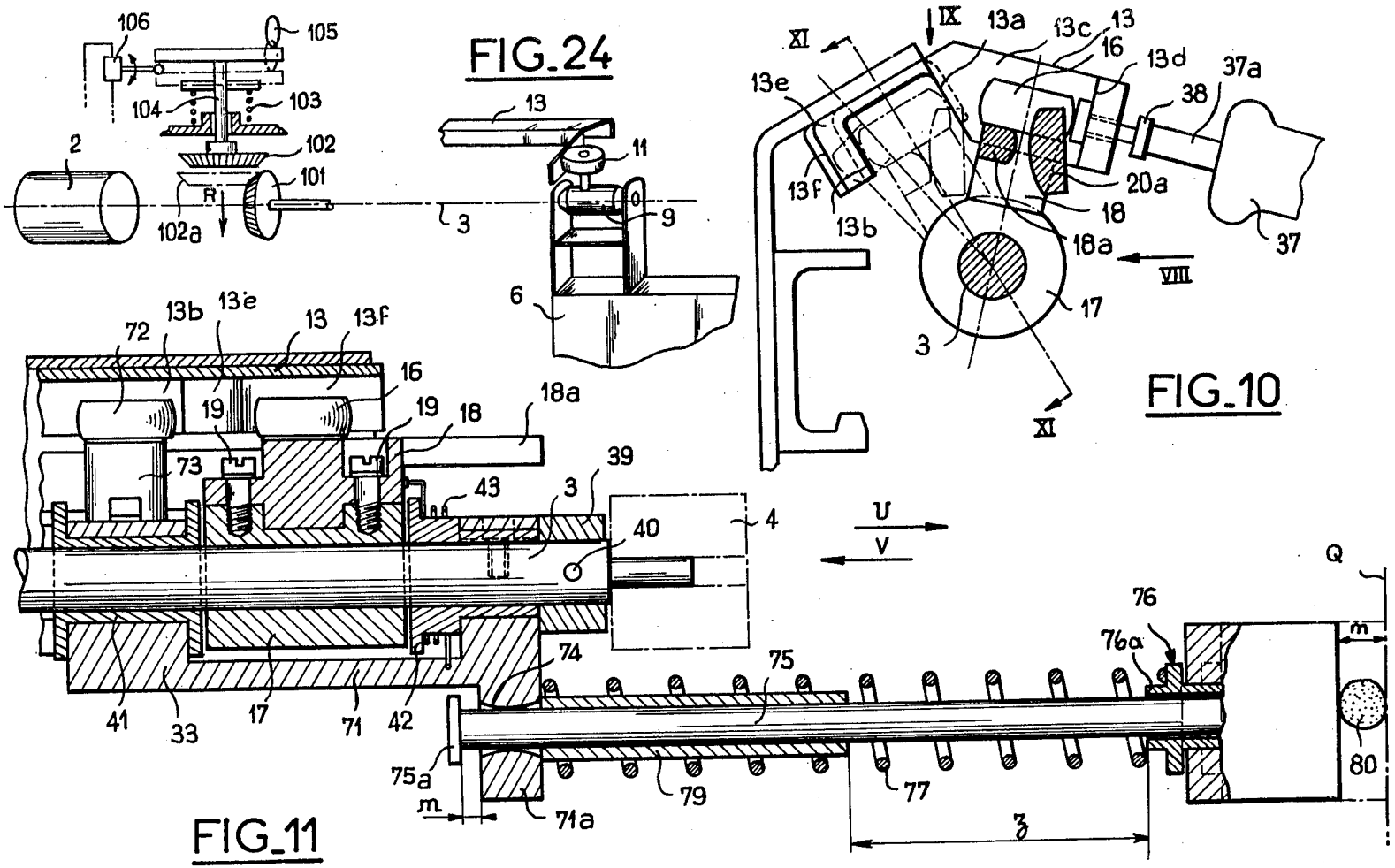
FIG. 10 is a part-sectional view taken along line X—X of FIG. 9 and showing the locking device in the locked position.
FIG. 11 is a part-sectional view taken along line XI—XI of FIG. 10 and showing an alternative embodiment of the invention in the unlocked end-of-travel position.
FIG. 24 is a diagrammatic illustration of an alternative form of construction.

FIG. 10 shows the respective positions of the finger 18*a* and of the end 20*a* of the lever 20. In this embodiment, the locked position of the roller 16 is detected by means of a position detector 37, the movable end portion 37*a* of which is applied against the roller 16 by means of the push-rod unit 38 which is slidably mounted in the wall 13*d* of the guide 13.

As shown in FIG. 11, the endless screw 3 is adapted to carry at the end of travel a stop-ring 39 which is secured to said endless screw by means of a locking-pin 40.

The stop-ring 39 is intended to limit the translational displacement of the fork 33 and therefore of the nut 17 along said endless screw 3 whilst sliding motion of the fork 33 along the screw is carried out by means of two bearings 41 and 42.

A helical spring 43 mounted on the bearing 42 which forms a drum connects the support 18 of the roller 16 to the fork 33. The spring 43 thus prevents unlocking of the nut 17 under the action of vibrations when said nut is in the locked position.

The operation of the device as thus constituted will now be described with reference to FIGS. 12 to 17.

Figure 12:
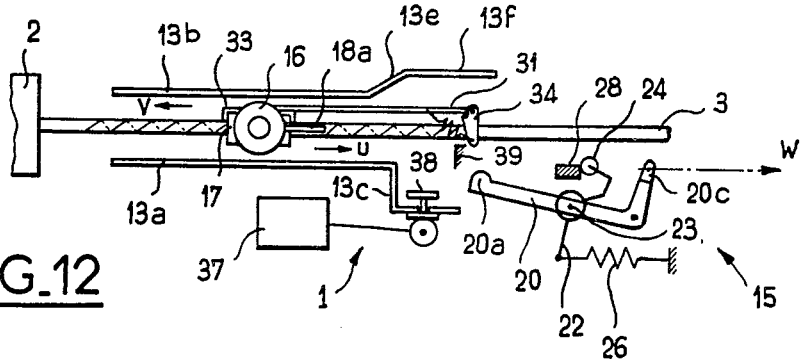
FIGS. 12, 13, 14, 15, 16 and 17 are functional diagrams of the control system of a sliding door equipped with the automatic locking device and with the remote-controlled unlocking device in different positions.

When the endless screw 3 is driven in rotation by the electric motor 2 in the direction V, the roller 16 travels in contact with the wall 13*b* of the guide 13 (FIG. 12). If the movement of translation takes place in the direction U, the roller 16 travels in contact with the wall 13*a* of said guide.

At the end of travel (for example in the position of closure of the door-leaf 6), the nut 17 reaches the recessed portion A (FIG. 13) in which it is no longer guided in translational motion and then rotates with the endless screw 3 in the direction of the arrow S, assuming that the nut 17 moves in the direction of the arrow U.

Figure 14:
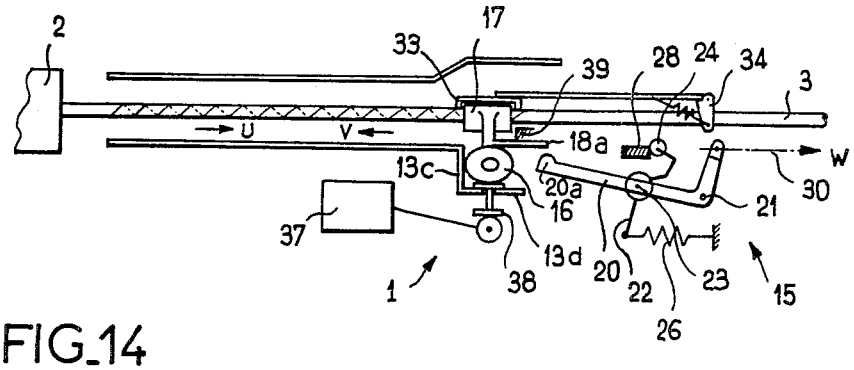

The roller 16 also rotates in the direction of the arrow S along the wall 13*c* and is applied against the pushrod 38 of the wall 13*d*. The position detector 37 then stops the electric motor 2. The nut 17 and the fork 33 are then maintained stationary without being applied against the stop-ring 39 (as shown in FIG. 14).

In order to effect the unlocking of the nut 17 and of the roller 16, the unlocking lever 20 is rotated in the direction W by means of the remote-control member 30. The lever 20 which rotates about its pivot-pin 21 takes up the position shown in chain-dotted lines in FIG. 9 and in full lines in FIG. 15. The end 20*a* of the lever 20 thrusts back the finger 18*a* during this movement of rotation.

The pawl which is coupled to the unlocking lever 20 by means of its pivot-pin 23 is displaced at the same time as a result of rotation of said lever.

Figure 15:
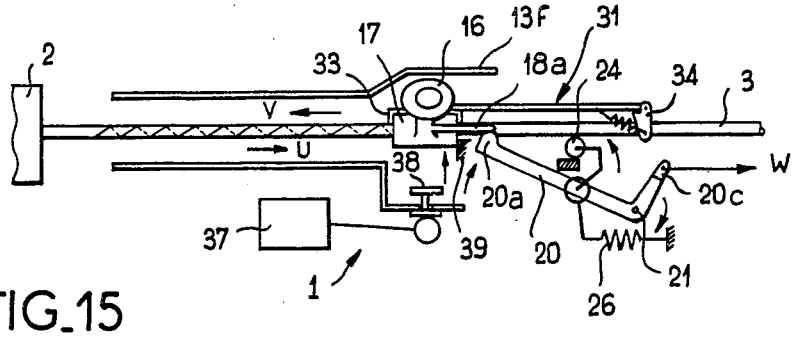

Also at the same time, the roller 24 of the pawl 22 passes upwards onto the stationary stop 28 against which it had been applied and remains engaged with said stop under the action of the restoring spring 26 when the remote-control member 30 no longer exerts any effort in the direction of the arrow W. The lever 20 thus remains in the unlocking position (FIG. 15).

FIG. 20 serves to show the functions performed by the stop-ring 39 and by the different walls of the guide 13 with respect to the roller 16.

When the roller 16 is locked in the position $M_1$, the action of the unlocking lever 20 first tends to cause the nut 17 to rotate about the stationary endless screw 3, thus initiating the displacement of the roller 16 towards the stop-ring 39 in the position $M_2$. The action of the unlocking lever 20 then necessarily causes the endless screw 3 to rotate in the direction T whilst the nut 17 is secured against translational motion by means of the stop-ring 39.

The roller 16 is thus brought into the position $M_3$ corresponding to the end of angular displacement of the unlocking lever 20 opposite to the guide 13.

If said roller 16 is locked in an intermediate position $N_1$, for example, and applied against the wall 13*d*, the unlocking lever 20 will first bring said roller to position $N_2$ against the stop-ring 39, then to position $M_3$.

The unlocking operation is thus completed.

In order to engage the nut 17 within the guide 13, it is only necessary to exert an effort on the nut in the direction of the arrow V by means of the door-leaf which is associated with the fork 33. The nut 17 then undergoes translational motion and drives the endless screw 3 in the direction of the arrow S. During this movement, the roller 16 is guided in translational motion by the finger 18*a* which is maintained applied against the end 20*a* of the unlocking lever 20 by means of the helical spring 43. Then, when the finger 18*a* moves away from this position of application at $M_4$ for example, the roller 16 comes into contact with the wall 13*a* of the guide 13 and moves away in the direction V as it runs along said wall.

The relative positions on the one hand of the walls 13*a* and 13*c* and on the other hand of the walls 13*b* and 13*e* make it possible to ensure correct engagement of the roller 16 within the guide 13 in respect of different settings of angular displacement of the unlocking lever 20, namely in respect of different positions of the rectilinear path of travel $M_3$–$M_4$ of the roller 16.

Figure 16:
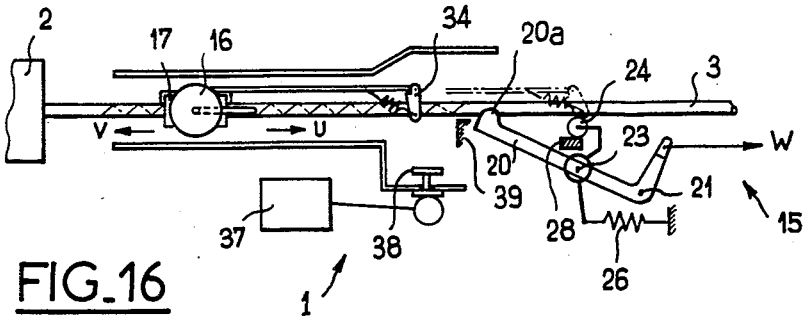
Figure 17:
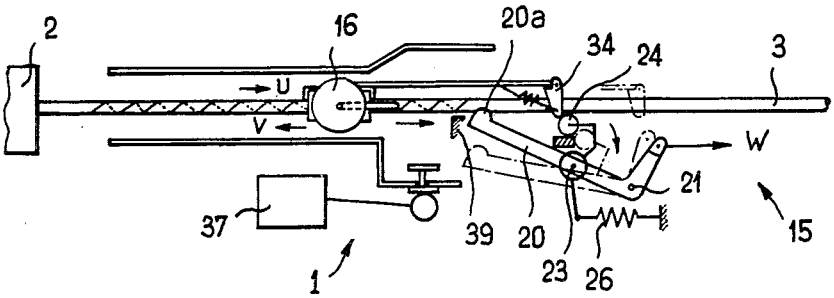

Resetting of the unlocking device is carried out as follows:

As it moves away from the end-of-travel position, the fork 33 is accompanied by the rod 31, the lug 34 of which withdraws at the time of passage of the roller 24 which thus remains engaged with the stationary stop 28 (FIG. 16). In order to restore the unlocking lever 20 to its initial position, it is only necessary to return the door-leaf 6 to the end-of-travel position, either by means of the motor 2 or by hand. During this displacement in the direction of the arrow U, the lug 34 which is retained by the heel-shaped projection 34*a* thrusts the roller 24 away from the stationary stop 28. Since it is no longer retained by the pawl 22, the lever 20 is accordingly reset (FIG. 17).

The position detector 29 delivers a signal which indicates the position of the unlocking lever 20 and the movable tip 29*a* of said detector still remains applied against the index 20*b* of said lever.

Figure 13:
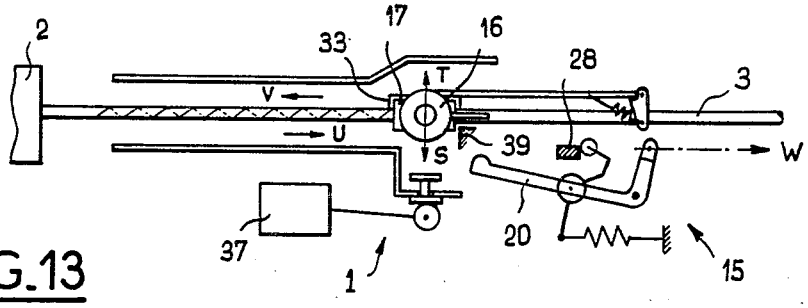

In order to release the nut 17 without having recourse to the unlocking device 15, it is only necessary to cause said nut to rotate in the direction T as indicated in FIG. 13. When the roller 16 comes into contact with the wall 13*f*, said roller is guided in translational motion by the walls 13*f*, 13*e* and 13*b* and subsequently moves in the direction of the arrow V.

It is shown in FIG. 20 that, starting from a bearing position $P_1$ on the wall 13*d*, the roller 16 comes directly to the position $P_2$ in which it is applied against the wall 13*f* solely as a result of rotational motion, whereupon the roller follows the wall 13*e*, then the wall 13*b*.

The embodiment under consideration makes it possible to remedy a failure of the system for controlling the endless screw 3, for example in the event of occurrence of an electric fault condition. A simple action produced by the remote-control member 30 in the direction of the arrow W makes it possible to release the door-leaf and actuate this latter by hand.

Moreover, the position detectors 29 and 37 serve respectively to detect the position of the unlocking lever 20 and the locked or non-locked position of the roller 16, thus making it possible to achieve automatic operation of the control systems.

Finally, the helical spring 43 serves to maintain the nut 17 in the locked position in spite of any vibrations.

In the embodiment which is shown diagrammatically in FIG. 24, the manual unlocking device comprises two bevel drive pinions 101, 102. The pinion 101 is carried by the endless screw 3. The pinion 102 is capable of axial sliding motion in the direction of the arrow R at right angles to the endless screw 3 but is normally maintained at a distance from the pinion 101 by means of an opposing spring 103 which is mounted coaxially on the sliding shaft 104, a hand-wheel and operating crank 105 being also mounted on said shaft. It is apparent that, by displacing the crank-handle 105 in the direction of the arrow R, the pinion 102 is disposed in meshing engagement with the pinion 101 (position 102*a*). By turning the crank-handle 105 and thus causing the endless screw 3 to rotate, the roller 11 of the nut 9 can be brought opposite to the guide 13. An end-of-travel contact 106 serves to cut-off the supply of the motor 2 when the pinion 102 is in the position 102*a*.

Other alternative modifications can be made in this first embodiment with a view to preventing the nut 9 or 17 in locked position from being released under the action of vibrations.

In the embodiment shown in FIG. 21, provision is made for a retractable ball 64 fitted with a restoring spring 65.

The spring 65 is applied against the bottom of a housing 66 secured to the wall 13*c* of the guide 13 and urges the ball 64 against an orifice of the wall 13*c*. The ball 64 projects to a slight extent into the recessed portion A, thus maintaining the roller 16 abuttingly applied in the locked position.

In the embodiment shown in FIGS. 8 and 9, the locking device 1 is disposed at the end of travel in the direction of closure so as to constitute a means for locking the door in the closed position. As can readily be understood, this device can also be disposed at the end of travel in the direction of opening.

Two locking devices can also be disposed in one case at the end of travel in the direction of closure and in the other case at the end of travel in the direction of opening in order to lock the sliding door in its two end positions.

The two recessed portions formed at the ends of the guide are located in one case in such a manner as to interrupt the wall 13*a* as described earlier at one end of said guide and in the other case in such a manner as to interrupt the wall 13*b* at the other end.

Figure 18:
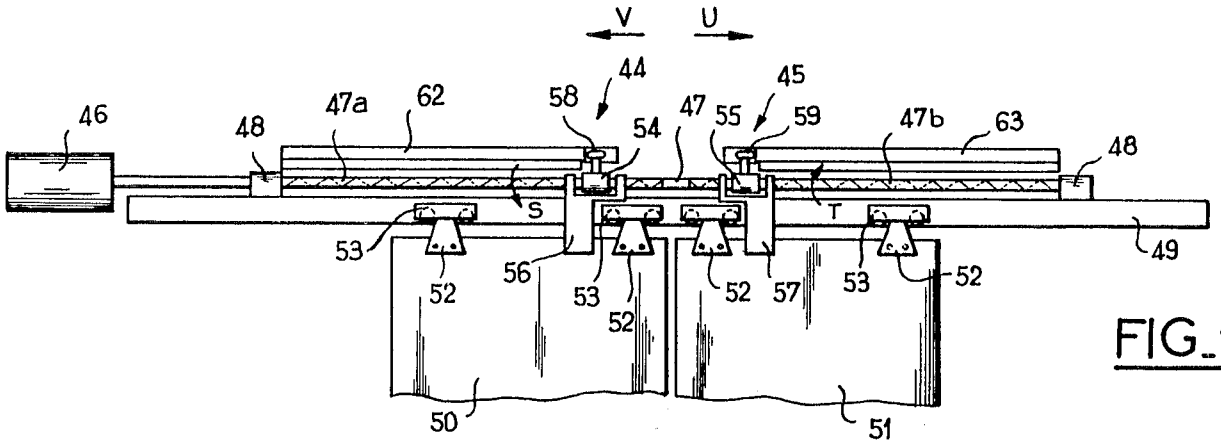
FIG. 18 is a diagrammatic presentation of a system for direct control of a sliding door having two associated leaves.

As shown in FIG. 18, the invention can be applied to a sliding door having two leaves 50, 51, each door-leaf being fitted with a locking device 44, 45 respectively as described in the foregoing.

The control system aforesaid comprises an electric motor 46 for driving an endless screw 47 in rotation, said screw being provided with two portions 47*a* and 47*b* having screw-threads of opposite hand and being rotatably mounted in two stationary bearings 48 fixed on a rail 49 from which the two leaves 50 and 51 of the sliding door are suspended.

The means for suspending each door-leaf from the rail 49 comprise two suspension plates 52 pivotally attached respectively to two carriages 53. The nuts 54 and 55 having screw-threads of opposite hand are mounted respectively on each portion 47*a* and 47*b* of the endless screw 47. Said nuts are coupled with the forks 56 and 57 in translational motion, the forks themselves being rigidly fixed respectively to the door-leaves 50 and 51. The guides 62 and 63 which are located in the line of extension of each other and parallel to the endless screw 47 constitute respectively means for guiding the rollers 58 and 59 in translational motion, said rollers being rotatably mounted on the nuts 54 and 55.

The locking devices 44 and 45 of the aforementioned type are illustrated by way of example in FIG. 18. Said devices are placed symmetrically with respect to each other at the end of travel of the door-leaves 50 and 51 in the direction of closure.

The displacements of the door-leaves are combined by means of the rotation of the endless screw 47 having threads of opposite hand and the locking devices 44, 45 come into action conjointly in the manner explained above.

In the closed position, the junction of the two door-leaves may not take place exactly in the plane P; in this case, the rollers 58 and 59 are each in the locked position at unequal distances from the walls 62*c* and 63*c*, for example p and g as shown in FIG. 22. In this configuration, the two door-leaves can be displaced either simultaneously or separately in both directions by the distance $p+q$ which constitutes an operating clearance at the time of closure.

This form of construction is advantageous since it makes it possible to control a sliding door having two leaves and to ensure locking of this latter in the closed position by means of a single operating member.

It will further be noted from the embodiment of FIG. 18 that, as soon as one of the two nuts is caused to rotate, the second nut is necessarily driven in rotation. Since the difference in position between the two nuts is very small, the fact of unlocking one of the two nuts necessarily initiates unlocking of the second nut.

In a third embodiment which is illustrated in FIG. 11, the nut 17 is coupled in translational motion with a fork 71 which is slidably mounted on the endless screw 3 by means of two bearings 41 and 42. The fork 71 carries a roller 72 mounted on a shaft 73. The roller 72 cooperates with the guide 13 so as to guide the fork 71 in translational motion.

The fork 71 carries a sliding rod 75 provided with a stop 75*a* at one end and connected at the other end to the door-leaf (not shown) by means of a support member 76. The rod 75 passes through an orifice 74 having a double flare and formed in a projecting portion 71*a* of the fork 71, thus permitting an angular displacement of the rod 75 through approximately 10° with respect to the fork 71.

There is placed around the rod 75 a helical spring 77 which is applied against the support member 76 and a travel-limiting sleeve 79, the length of which is shorter than the distance y between the projecting portion 71*a* and the support member 76.

The operation of the device is as follows:

When the door-leaf which is attached to the connecting support member 76 moves in the direction of the arrow U towards its end-of-travel position without meeting any obstacle, limitation of translational motion of the nut 17 is ensured by means of the stop-ring 39 which is placed at the end of the endless screw 3 and secured to said screw by means of the locking-pin 40.

Locking of the nut 17 is performed in the normal manner as described in the foregoing. The same applies to the unlocking operation which is performed by means of the endless screw 3 which disengages the nut 17 or by means of the unlocking device which produces action on the finger 18*a* attached to the nut 17.

The angular displacement of the fork 71 about the axis of the endless screw 3 which corresponds to the operating clearance permitted between the walls of the guide 13 and the roller 72 is made possible despite the presence of the rod 75 by virtue of the flared orifice 74.

On the other hand, if the door-leaf encounters an obstacle 80 which forms a stop at a distance m from the plane Q, the nut 17 can continue its travel as well as the fork 71 by virtue of the sliding motion of the rod 75 within the orifice 74 with correlative compression of the spring 77. The clearance m which is thus permitted is equal at a maximum to the distance z between the sleeve 79 and an end-piece 76*a* of the support member 76 in the fully closed position.

The effort exerted by the spring 77 maintains the roller 16 applied against the wall 13*c* (FIG. 20) and the helical spring 43 maintains said roller 16 applied against the wall 13*d*. When the unlocking operation is carried out by means of the endless screw 3, the roller 16 moves away from the wall 13*c* at $M_{10}$ towards a position in which it is applied against the wall 13*b* and continues to move in the direction of the arrow V.

If the unlocking operation takes place by means of the unlocking device 15, the roller 16 is moved from $M_1$ to $M_{10}$ and then to $M_{12}$ as a result of action produced on the finger 18*a*.

When the door-leaf is displaced by hand in the direction V, the roller moves from $M_{12}$ to $M_4$, at which point the finger 18*a* moves away from the end portion 20*a* of the unlocking lever; the combined effects of the reaction of the endless screw 3 which is driven by the nut 17 and of the action of the helical spring 43 result in displacement of the finger which is applied against the wall 13*a* at $M_5$.

If m is higher than the initial and predetermined value z which corresponds to the maximum permissible clearance in the closed position, locking of the nut 17 is not possible.

This embodiment is advantageous since it endows the door-leaf with a degree of freedom in translational motion with respect to its control system. Thus, even if an obstacle having a dimension smaller than the predetermined value z is placed between the fixed jamb post of a doorway and the movable edge of the door-leaf, locking and unlocking take place in the normal manner.

Figure 19:
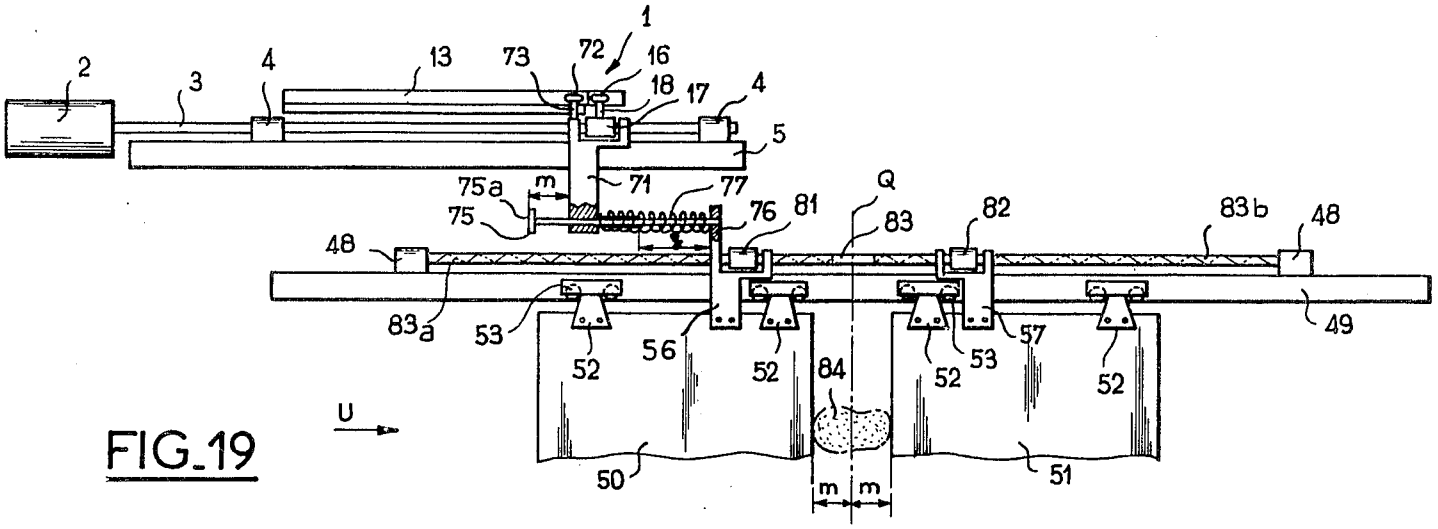
FIG. 19 is a diagrammatic presentation of a system for indirect control of a sliding door having two associated leaves.

The locking device which provides a predetermined opening clearance z in accordance with FIG. 11 can be applied to a door having two associated leaves as shown in FIG. 19. To this end, the support member 76 of FIG. 11 is not only attached to one of the door-leaves 50 but also carries a fork 76*a* for a nut 81 mounted on an endless screw having two threaded portions 83*a*, 83*b* of opposite hand. The portion 83*b* is intended to receive a nut 82 which is coupled to the doorleaf 51 in translational motion by means of a fork 57 attached to this latter.

By virtue of these connections, locking is possible as long as the controlled door-leaf 50 is located at a distance m from its end-of-travel position Q, said distance being shorter than the initial predetermined length of z. It is accordingly possible to interpose between the two door-leaves 50 and 51 an obstacle 84 which forms a stop and maintains said door-leaves at a distance equal to 2 z at a maximum.

If the interposed obstacle 84 is greater than double the predetermined initial value of z, locking of the nut 17 will not be possible.

This alternative embodiment combines all the advantages provided by a single and independent control system applied to the control of a sliding door having two leaves while at the same time ensuring that the safety conditions laid down in public transport vehicles are satisfied, namely that an obstacle of a certain size can be interposed between the two door-leaves without interfering with their locking action.

The invention is clearly not limited to the embodiments described in the foregoing and alternative forms of construction can in any case be contemplated.

Thus the forks can be located in a plane which is different from that of the door-leaf and different from the plane which passes through the axes of the endless screws and corresponding guides. The arrangements thus obtained are readily adaptable to the curvature of transportation vehicle bodies equipped with doors of this type.

Moreover, the nut 9 which serves to carry out the locking operation need not be mounted on an endless screw but, as shown in FIG. 23, could be placed on the threaded end 91 of a sliding rod 92 which can be displaced in translational motion in the directions U and V by means of a linear motor 93.

As in the embodiments described earlier, the nut 9 carries a roller 11 which is capable of displacement within a guide 13; said guide opens into the recessed portion A which is limited by a stop 94.

When the roller 11 is applied against the stop 94 and the rod 92 continues to advance at least over a predetermined distance, the nut 9 cannot advance with rod 92 and so is caused to rotate about the rod 92 by the cam action of the screw threads at 91 and comes into the locking position. Of course, the fact that the nut 9 rotates about the rod 92 means that the rod 92 does not rotate relative to motor 93.

It will further be noted that, in the design of the recessed portion A shown in FIG. 20, for example, the setback portion 13*e*, 13*f* of the wall 13*b* corresponds to a particular case related to a particular arrangement of the manual unlocking device (not shown). As a general rule, it is possible to replace the walls 13*e*, 13*f* by a single rectilinear wall 13*q* located in the line of extension of the wall 13*b*. The result thereby achieved is to facilitate the operation of the device.

We claim:

1. A device for locking a door, especially a sliding door which is driven by a motor and comprises at least one leaf coupled to a nut mounted on an endless screw which is driven in rotation in order to effect opening and/or closing of the door, said nut being displaced in translational motion within a guide which prevents rotational motion, wherein said locking device comprises means for interrupting the translational displacement of the guided nut at the end of travel and for permitting angular rotation of said nut with said endless screw, means for limiting the angular displacement of said nut and finally means for limiting the translational motion of the nut if said nut is displaced along said screw and no longer engaged within said guide.

2. A device according to claim 1, wherein the nut carries a projecting member which serves to locate the angular position thereof and is provided with means for facilitating the guiding of said nut.

3. A device according to claim 1, wherein the means for interrupting translational guiding of the nut consist of a limitation of the guide before the position of end of travel of said nut on the endless screw.

4. A device according to claim 1, wherein said device comprises means which serve to detect locking of the door and comprise an end-of-travel contact associated with the abutment member for stopping rotational motion of the nut, said contact being actuated by said nut in the locking position.

5. A device according to claim 1, wherein provision is made after the limitation of the guide for a recessed portion which permits rotational motion of the nut, said recessed portion being provided with an abutment member for stopping the rotation of the nut when said nut has reached a predetermined angular position corresponding to the locking action.

6. A device according to claim 4, wherein the means for limiting the translational displacement of the nut within the recessed portion of the guide comprise a wall which serves as a stop for said nut, limits the length of said recessed portion and extends transversely with respect to the axis of the endless screw.

7. A device according to claim 4, wherein the recessed portion comprises means for guiding the nut towards the entrance of the guide when said nut is in the unlocked position within said recessed portion.

8. A device according to claim 1, wherein said device comprises remote-controlled means for returning the nut from its locking position to the predetermined angular position with respect to the guide which corresponds to unlocking.

9. A device according to claim 8, wherein the means for unlocking the nut comprise a gear system in which one of the pinions is carried by the endless screw and the other pinion is coupled to a crank, said two pinions being engageable by hand and normally maintained at a distance from each other by an elastic member.

10. A device according to claim 8, wherein the unlocking means comprise an unlocking lever connected to a control link-rod system, said lever being adapted to cooperate with a finger carried by the nut, the respective positions of said lever and said finger being such as to permit rotational motion of the nut on the endless screw in the event of operation of said lever.

11. A device according to claim 9, wherein the unlocking lever is provided with a retractable pawl for maintaining said lever in the unlocking position, said pawl being engaged with a stationary stop when said unlocking lever is in the unlocked position.

12. A device according to claim 10, wherein said device comprises means coupled to the door-leaf in translational motion for returning the unlocking lever to the inactive position at the end of travel of said door-leaf, said means being constituted by a retractable lug which produces action on the pawl of the unlocking lever in order to release said lever from its stationary stop.

13. A device according to claim 1, wherein said device comprises means for preventing unlocking of the nut in the locked position under the action of vibrations.

14. A device according to claim 13, wherein the means aforesaid comprise a helical spring mounted on a drum rigidly fixed to a fork for coupling the nut to the door-leaf, one end of said spring being attached to the nut and the other end being attached to said fork.

15. A device according to claim 14, wherein the means aforesaid comprise a retractable ball having elastic restoring action which projects into the recessed portion in the rest position and is located on the path of the projecting member of the nut.

16. A locking device according to claim 1, wherein said device is disposed both at the end of travel on the side corresponding to the direction of opening and at the end of travel on the side corresponding to the direction of closing of the sliding door.

17. A locking device according to claim 1 for a door having two associated leaves operated in opposition by means of a common endless screw having two threaded portions of opposite hand, each threaded portion aforesaid being fitted with a nut coupled with one of said leaves in translational motion, wherein each nut is capable of angular displacement in the locking position when driven by the endless screw and thus escapes from the translational-motion guide which is associated with said endless screw.

18. A locking device according to claim 1 for a door having two associated leaves, each door-leaf being coupled with a nut in translational motion by means of a fork which embraces said nut, said two nuts being mounted on a common endless screw having two threaded portions of opposite hand, wherein the locking device is applied to a second endless screw which is driven in rotation in both directions and carries a driving nut mounted within a fork and wherein connecting means provide a mechanical linkage between said fork and at least one of the forks carried by the door-leaves in order to couple them in translational motion over at least part of their range of travel.

19. A device according to claim 1, wherein the means for mechanically coupling the fork associated with the driving nut with at least one of the door-leaves comprise means for permitting a relative movement of translation which is limited in the direction of opening of the door-leaf with respect to the driving fork.

20. A device according to claim 19, wherein the means for permitting a limited relative movement of translation of at least one of the door-leaves comprise a slide arranged between the driving nut and the door-leaf and an elastic restoring member which tends to maintain said slide in the position of maximum extension.

21. A device for locking a sliding door which is driven by a motor and comprises at least one leaf actuated by a linear motor by means of a sliding rod, wherein said rod is provided with a threaded portion on which is mounted a nut coupled to said door leaf, said nut being displaceable in translational motion within a guide which prevents rotational motion, wherein said locking device comprises means for interrupting the translational displacement of said guided nut at the end of travel and for permitting angular rotation of said nut by action of a predetermined movement of translation of said threaded rod, means for limiting the angular displacement of said nut and finally means for limiting the translational motion of the nut if said nut is displaced along said rod and no longer engaged within said guide.

* * * * *